US007230391B2

(12) United States Patent
Ravindra et al.

(10) Patent No.: US 7,230,391 B2
(45) **Date of Patent: *Jun. 12, 2007**

(54) MULTI-PHASE INPUT DIMMING BALLAST WITH FLYBACK CONVERTER AND METHOD THEREFOR

(75) Inventors: Thotakura Venkata Ravindra, Haryana (IN); Ayan Kumar Choudhury, Haryana (IN)

(73) Assignee: Osram Sylvania, Inc., Danvers, MA (US)

( * ) Notice: Subject to any disclaimer, the term of this patent is extended or adjusted under 35 U.S.C. 154(b) by 152 days.

This patent is subject to a terminal disclaimer.

(21) Appl. No.: 11/118,634

(22) Filed: Apr. 29, 2005

(65) Prior Publication Data

US 2005/0269974 A1 Dec. 8, 2005

(51) Int. Cl.
*H05B 37/02* (2006.01)

(52) U.S. Cl. ..... 315/219; 315/224; 315/DIG. 4

(58) Field of Classification Search ..... 315/207, 315/219, 224, DIG. 4
See application file for complete search history.

(56) References Cited

U.S. PATENT DOCUMENTS 6,534,931 B1 * 3/2003 Konopka et al. ..... 315/291
2005/0062436 A1 * 3/2005 Jin ..... 315/244

* cited by examiner

*Primary Examiner*—David Vu
(74) *Attorney, Agent, or Firm*—Fitch, Even, Tabin & Flannery

(57) ABSTRACT

An apparatus and method for powering a lamp connected to a ballast circuit. The ballast circuit is connected to a first alternating current (AC) source having a first phase and to a second AC source having a second phase. A first rectifier circuit is connected between the first AC source and a first switching circuit. A second rectifier circuit is connected between the second AC source and a first switching circuit. A control circuit selectively energizes the first and second switching circuits to provide power from the first and second AC sources to the lamp load via an inverter circuit. A detection circuit generates a detection signal indicating whether power is being supplied by each the first and second AC sources. The detection signal is provided to a dimming regulation circuit to generate a dim level command signal for dimming the lamp.

20 Claims, 8 Drawing Sheets

MULTI-PHASE INPUT DIMMING BALLAST WITH FLYBACK CONVERTER AND METHOD THEREFOR

TECHNICAL FIELD

The present invention relates to dimmable ballast systems. In particular, the invention relates to a method and apparatus for powering a dimmable ballast from a multi-phase input source.

BACKGROUND OF THE INVENTION

Fluorescent lamps economically illuminate an area. Due to the unique operating characteristics of fluorescent lamps, the lamps must be powered by a ballast. Electronic ballasts provide a very efficient method of powering fluorescent lamps and for adjusting the illumination level of fluorescent lamps.

Generally, electronic ballasts are driven by a single AC (alternating current) voltage supply having a particular phase. When power factor correction is required, the electronic ballast typically has a boost front-end for converting the AC voltage from an AC power source into a DC (direct current) voltage which has a value greater than the peak voltage of the AC power source. An inverter then converts the DC voltage into high frequency AC power.

It is highly desirable that dimming ballasts be capable of being powered from a multi-phase input. More specifically, it is desirable to have an electronic ballast that can be driven by two different AC voltage sources that supply AC voltages at different phases.

SUMMARY OF THE INVENTION

In accordance with one aspect of the invention, a ballast circuit is provided for connection to a first alternating current (AC) source and a second AC source. The ballast includes a first rectifier circuit connected to the first AC source for generating a first direct current (DC) input power signal. A second rectifier circuit is connected to the second AC source for generating a second DC input power signal. A first switching circuit is connected to the first rectifier circuit for receiving the first DC input power signal, and for generating a first DC output power signal as a function of the first DC input power signal. A second switching circuit is connected to the second rectifier circuit and receives the second DC input power signal, and generates a second DC output power signal as a function of the second DC input power signal. A dimming regulation circuit generates a dim level command signal as a function of whether power is being supplied by each of the first and second AC sources to the lamp. An inverter circuit is coupled between the first and second switching circuits and to the lamp. The inverter circuit is responsive to the dimming regulation circuit to control an amount of power being provided to the lamp as a function of the dim level command signal.

In accordance with another aspect of the invention, a method is provided for powering a lamp connected to a ballast circuit. The method includes supplying a first AC input signal and a second AC input signal to the circuit. The method also includes converting the first and second AC input signals into first and second direct current (DC) input signals, respectively, and generating a first DC output signal as a function of the first DC input signal and generating a second DC output signal as a function of the second DC input signal. The method also includes generating a dim level command signal as a function of whether each of the first and second AC input signals are being supplied to circuit. The method further includes supplying power to the lamp as a function of the dim level command signal and the first and second DC output signals.

In accordance with another aspect of the invention, a method is provided for powering a lamp connected to ballast circuit. The method includes supplying a first input signal and a second input signal to the circuit. The method also includes generating a first output signal as a function of the first input signal and generating a second output signal as a function of the second input signal. The method also includes generating a detection signal having a parameter representative of whether each of the first and second input signals are being supplied to the circuit, wherein the parameter of the detection signal has a first magnitude when both of the first and second input signals are being supplied to the circuit and has a second magnitude when only one of the first input and second input signals are being supplied to the circuit. The method further includes supplying power to the lamp as a function of the generated detection signal and the first and second output signals.

Alternatively, the invention may comprise various other methods and apparatuses.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1A:
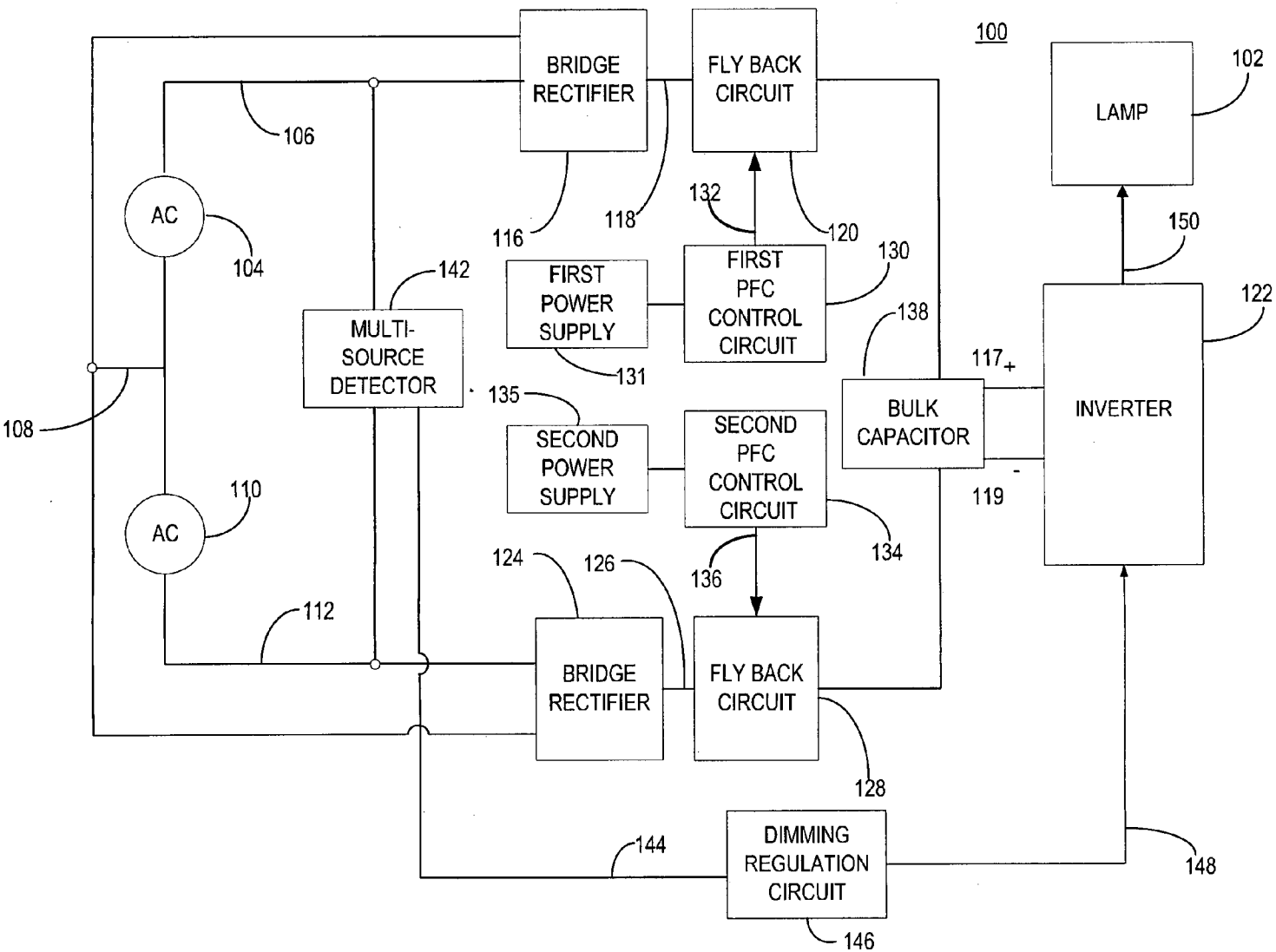
FIG. 1A is a block diagram illustrating a multi-phase input dimming ballast circuit for powering a lamp, according to one preferred embodiment of the invention.
Figure 1B:
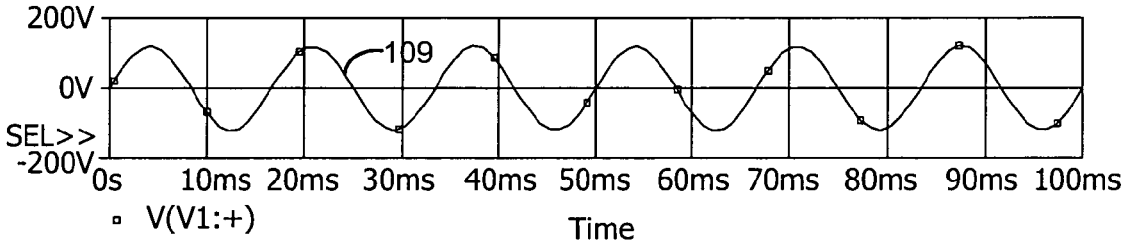
FIGS. 1B and 1C illustrate exemplary waveforms of AC voltage signals produced by AC voltage sources, according to one preferred embodiment of the invention.
Figure 1C:
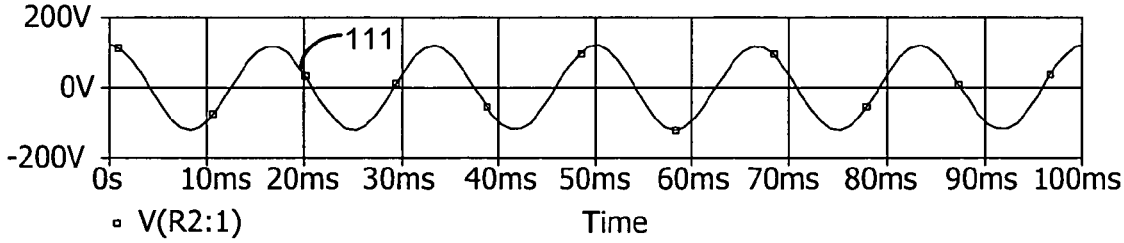

FIG. 1A is a block diagram of an embodiment of a multi-phase input dimming ballast 100 for powering a lamp 102. The ballast 100 receives power from a first AC power source 104 via power lines 106 and 108 and from a second AC power source 110 via power lines 112 and 108. The first AC power source 104 supplies a first AC voltage signal 109 (see FIG. 1B) having a particular phase via power lines 106 and 108, and the second AC power source 110 supplies a second AC voltage signal 111 (see FIG. 1C) having a different phase via power lines 112 and 108. The power lines 106 and 112 may be referred to as either "HOT" or "SUPPLY" and power line 108 may be referred to as "NEUTRAL" or "COMMON." Although the first and second AC voltage signals 109, 111 may have different phases, they generally have substantially the same voltage magnitude. FIGS. 1B and 1C show example waveforms of AC voltage signals 109, 111 produced by the first and second AC sources 104, 110, respectively. In this example, the phases of the signals are shifted by approximately 90 degrees.

A first bridge rectifier 116 is coupled to the AC power line 106 and the common line 108 and outputs a first input DC voltage signal 118 for powering the lamp 102 via a first flyback circuit 120 and inverter circuit 122. A second bridge rectifier 124 is coupled to the AC power line 112 and the common line 108 and outputs a second input DC voltage signal 126 for powering the lamp 102 via a second flyback circuit 128 and the inverter circuit 122. Each of the first and second bridge rectifiers 116, 124 are full wave rectifiers.

Figure 1D:
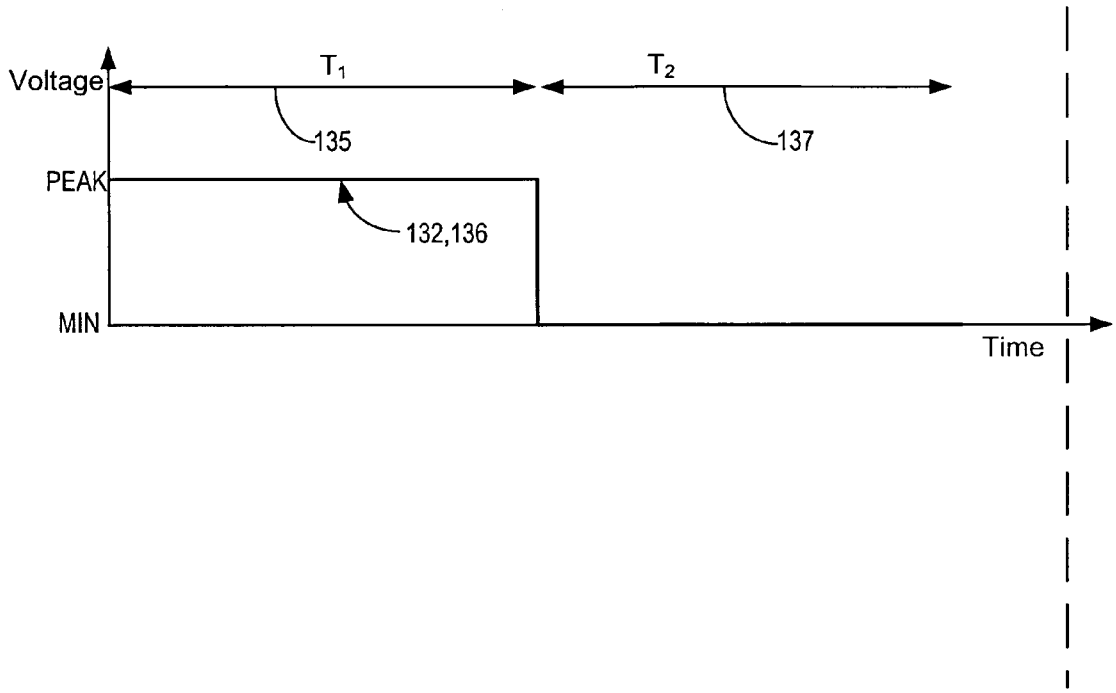
FIG. 1D illustrates an exemplary waveform of a control signal produced by a PFC controller, according to one preferred embodiment of the invention.

A first PFC control circuit 130 is coupled between a first DC power supply 131 and the first flyback circuit 120 and supplies a first control signal 132 to activate the first flyback circuit 120. A second PFC control circuit 134 is coupled between a second DC power supply 135 and the second flyback circuit 128 and supplies a second control signal 136 to activate the second flyback circuit 128. The first and second PFC control circuits 130, 134 are configured to insure a high power factor and low current total harmonic distortion, and to activate the first and second flyback circuits 120, 128 Each of the first and second control signals 132, 136 alternate between a peak magnitude and minimum magnitude. For example, during a first period of time, $T_1$, as indicated by reference character 135 (in FIG. 1D), the first control signal 132 provided by the first PFC control circuit 130 and the second control signal 136 provided by second PFC control circuit 134 each have a peak magnitude. However, during a next period of time, $T_2$, as indicated by reference character 137 (in FIG. 1D), the first control signal 132 provided by first PFC control circuit 130 and the second control signal 136 provided by PFC control circuit 134 each have a minimum magnitude. As described in more detail below in reference to FIGS. 1 and 2, when a control signal having a peak magnitude is supplied to one of the flyback circuits 120, 128, that particular flyback circuit stores energy in a primary winding, and when a control signal having a minimum magnitude is supplied to the same particular one of the flyback circuits 120, the energy stored in the primary winding is transferred to a secondary winding and produces an output DC voltage to power the lamp 102 via a bulk capacitor 138 and inverter 122. In addition, as described in more detail below in reference to FIG. 3A, when a control signal having a peak magnitude is supplied to a particular one of the flyback circuits 120, 128, that flyback circuit boosts the input DC voltage signal (e.g., input DC voltage signal 118 or input DC voltage signal 126) to produce an output DC voltage to power the lamp 102 via a bulk capacitor 138 and inverter 122. For purposes of illustration only, the first and second control signals 132, 136 are shown in FIG. 1D as having the same magnitude during the same period of time. It is to be understood however, that the magnitude of the first and second control signals 132, 136 may have different magnitudes at a particular instant in time.

A multi-source detection circuit 142 is coupled to the first AC power source 104 via power line 106 and coupled to the second AC power source 110 via power line 112. The multi-source detection circuit 142 generates a detection signal 144 that indicates whether one or both of the first and second AC voltage signals 109, 111 are being supplied to the ballast 100. For example, when both signals are being supplied, the multi-source detection circuit 142 generates a detection signal 144 having a low voltage magnitude (e.g., 0 volts). Alternatively, when at least one of the first and second AC voltage signals 109, 111 is absent (e.g., one source turned-off), the multi-source detection circuit 142 generates a detection signal 144 having a high voltage magnitude (e.g., 5 volts). The detection signal 144 can be provided to a dimming regulation circuit 146 to control dimming of the lamp 102. The dimming regulation circuit 146 is responsive to the detection signal 144 to generate the dim level command signal 148 as a function of the amplitude of the detection signal 144. Preferably, the amplitude of the dim level command signal 148 determines the inverter running frequency, and the inverter running frequency determines whether dimming of the lamp 102 occurs. For example, when one of the first or second AC sources is turned off, the detection signal 144 will have a peak magnitude. This change in status of the detection signal 144 will cause the dimming regulation circuit 146 to generate a dim level command signal 148 that causes an increase in the inverter running frequency to dim the lamp 102. More specifically, when one of the first or second AC sources 104, 110 is turned off, the detection signal 144 will have a peak amplitude and, thus, the dim level command signal 148 generated by the dimming regulation circuit 146 will have a peak amplitude. The inverter 122 is responsive to a dim level command signal 148 having a peak amplitude to operate at an increased frequency. Due to the increased operating frequency, the inverter 122 will provide an output signal 150 (i.e., lamp current) having a lower amplitude, causing the lamp 102 to dim. When both of the first and second AC sources 104, 110 are turned on, the detection signal 144 will have a minimum amplitude and the dim level command signal 148 generated by the dimming regulation circuit 146 will also have a minimum amplitude. The inverter 122 is responsive to a dim level command signal 148 having the minimum amplitude to operate at a decreased frequency. Due to the decreased operating frequency, the inverter 122 will provide an output signal 150 (i.e., lamp current) having a higher amplitude, causing the lamp 102 to be substantially bright (i.e., to operate in a full light, or non-dimming, mode). Thus, the dimming regulation circuit 146 operates to reduce the power applied to the lamp 102 when one of the AC sources 104, 110 is not generating an AC signal.

Figure 2:
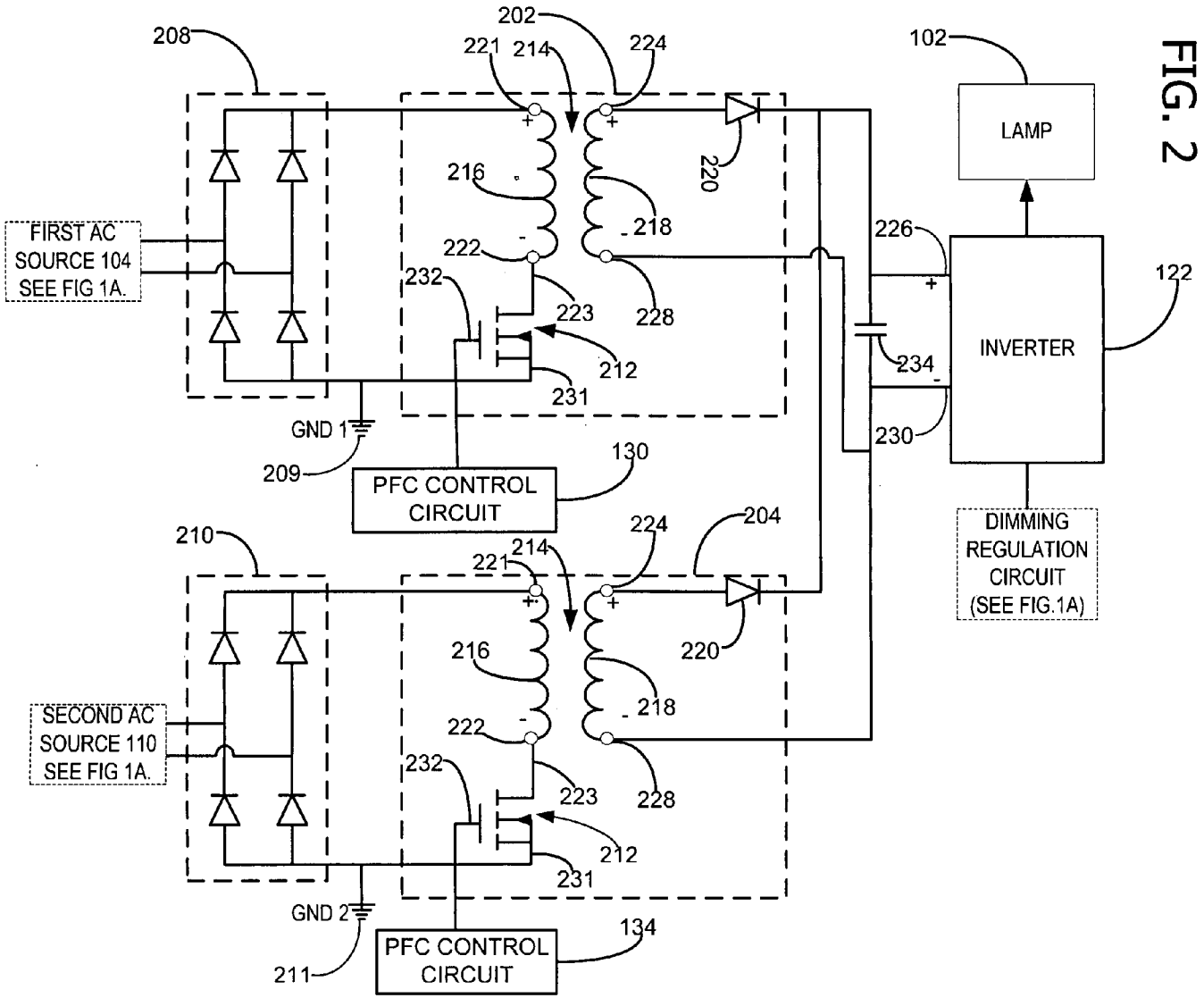
FIG. 2 is a schematic diagram illustrating components of first and second flyback circuits, according to one embodiment of the invention.

Referring now to FIG. 2, a schematic diagram illustrates components of a first flyback circuit 202 (e.g., flyback circuit 120) and a second flyback circuit 204 (e.g., flyback circuit 128) according to one embodiment of the invention. The first and second AC voltage sources 104, 110 are connected to first and second full wave rectifiers 208, 210 (e.g., first and second rectifiers 116, 124), respectively. The first rectifier 208 is connected to a first ground 209 and rectifies the first AC signal 109 from the first AC voltage source 104 to produce a first DC voltage signal. The second rectifier 210 is coupled to a second ground 211 and rectifies the second AC signal 111 from the second AC voltage source 110 to produce a second DC voltage signal. The first and second DC voltage signals are converted to first and second DC output voltages to power the lamp 102 via the inverter 122. In this embodiment, the first flyback circuit 202 produces the first DC output voltage, and the second flyback circuit 204 produces the second DC output voltage. Each of the flyback circuits 202, 204 includes a MOSFET transistor 212, a transformer 214 with a primary winding 216 and a secondary winding 218, and a diode 220.

In the first flyback circuit 202, a terminal 221 of the primary winding 216 is connected to the first bridge rectifier 208 and a terminal 222 of primary winding 216 is connected to a drain 223 of the mosfet 212. A terminal 224 of secondary winding 218 is connected to an input terminal 226 of the inverter 122 via the diode 220, and a terminal 228 of the secondary winding 218 is connected an input terminal 230 of the inverter 122. A source 231 of the mosfet 212 is coupled to the first rectifier 208 via the first ground 209. A gate 232 of the mosfet 212 is connected to the first PFC control circuit 130 and is responsive to the first control signal 132 generated by the PFC control circuit to turn the mosfet 212 on and off. For example, when the magnitude of the first control signal 132 is equal to or greater than a threshold voltage (i.e., first control signal has a peak magnitude), the mosfet turns on and current flows through the primary winding 216 of the transformer 214 and the energy is stored in the primary transformer winding. When the magnitude of the first control signal 132 is less than the threshold voltage (i.e., first control signal has a minimum magnitude), the mosfet 212 turns off and no current through the primary winding 216 of the transformer 214. During this period, the energy is transferred from the primary winding 216 to the secondary winding 218 and delivered through the diode 220 to produce an output DC voltage across a bulk capacitor 234.

The wiring configuration of the second flyback circuit 204 is substantially identical to the wiring configuration of the first flyback circuit 202. However, in the second flyback circuit 204, the source 231 of the mosfet 212 is coupled to the second rectifier 210 via the second ground 211. Moreover, the gate 232 of the transistor 212 is connected to the second PFC control circuit 134 and is responsive to the magnitude of the second control signal 136 generated by the second PFC control circuit 134 to turn the mosfet 212 on and off. The inverter 122 receives the DC output voltage from the first and second flyback circuits 202, 204 and converts the DC output to an AC signal for operating the lamp 102. In this particular embodiment, the outputs of the first and second flyback circuits 202, 204 are paralleled to supply the inverter 122.

Figure 3A:
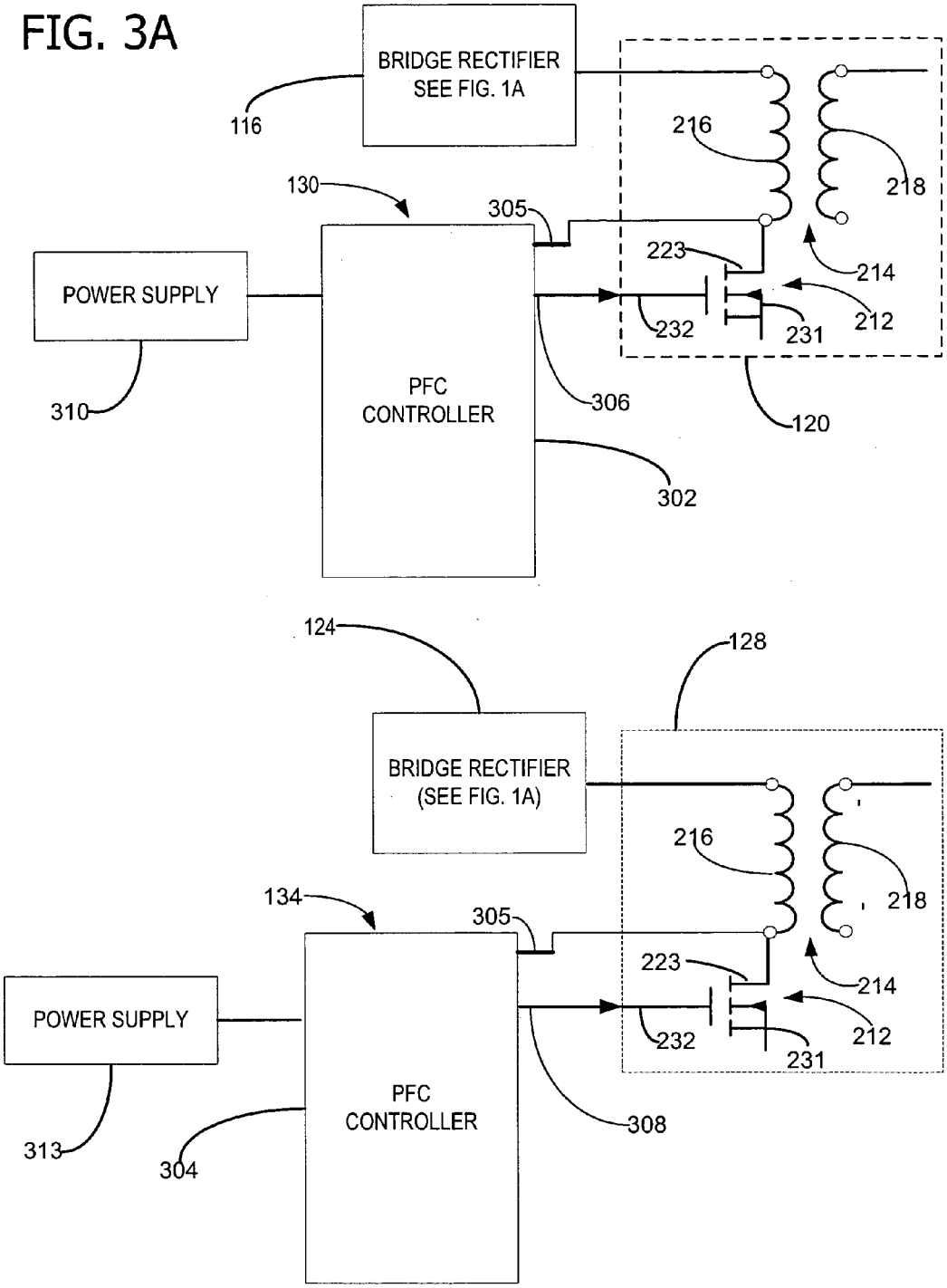
FIG. 3A is a schematic diagram illustrating components of first and second PFC control circuits, according to one preferred embodiment of the invention.
Figure 3B:
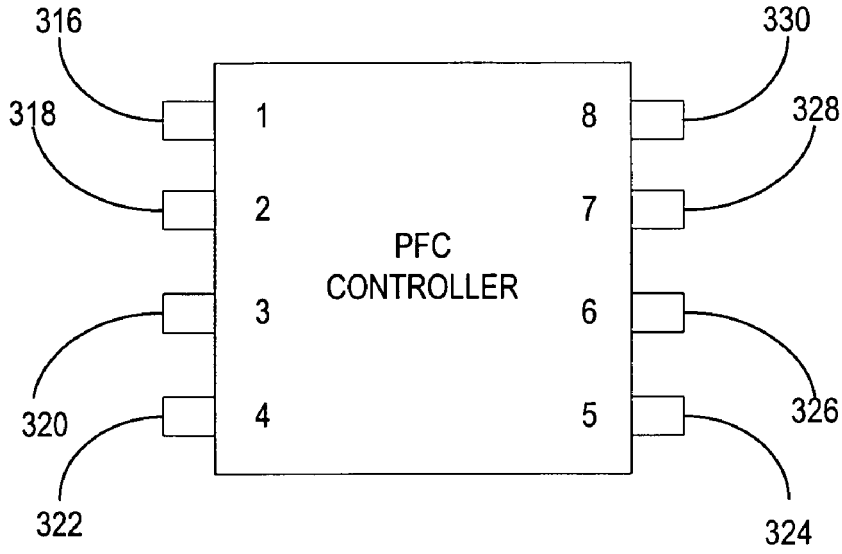
FIG. 3B is an exemplary block diagram showing pin connections of such a PFC controller.

Referring now to FIG. 3A, a schematic diagram illustrates components of a first PFC control circuit 130 and a second PFC control circuit 134 according to one embodiment of the invention. The first PFC control circuit 130 includes a first PFC controller 302 and the second PFC control circuit 134 includes a second PFC controller 304. For example, each of the first and second PFC controllers 302, 304 can be L6561 PFC controllers manufactured by STMicroelectronics of Plan les Ouates, Geneva, Switzerland. FIG. 3B is an exemplary block diagram showing pin connections of such a PFC controller. In this particular PFC controller, the pin connections include and inverting input 316 (i.e., pin 1), an error amplifier output 318 (i.e., pin 2), a multiplier stage input 320 (i.e., pin 3), a current sensing input 322 (i.e., pin 4), a zero current detection input 324 (i.e., pin 5), a ground 326 (i.e., pin 6), a gate driver output 328 (i.e., pin 7), and a supply voltage input 330 (i.e., pin 8). Referring now to FIGS. 3A and 3B, a first control signal 306 is output at the gate driver output 328 of first PFC controller 302 to turn the mosfet 212 of the first flyback circuit 202 on and off. A second control signal 308 is output at the gate driver output 328 of second PFC controller 304 to turn the mosfet 212 of the second flyback circuit 204 on and off. Power is supplied to voltage input 330 of the first PFC controller 302 by a first DC power supply 310 (e.g., 15V) generated from the first AC voltage source 104 (see FIG. 5), and power is supplied to voltage input 330 of the second PFC controller 304 by a second DC power supply 313 (e.g., 15V) generated from the second AC voltage source 110 (see FIG. 5). As described above in reference to FIG. 2, the mosfet 212 of the first and second flyback circuits 202, 204 is on when the corresponding control signal has a peak magnitude (e.g., 15 volts), and the transistor 212 is off when the corresponding control signal has a minimum magnitude (e.g., 0 volts). In operation, each of the PFC controllers (e.g., 302, 304 as described in FIG. 3A) output control signals having a peak magnitude to turn the corresponding mosfet 212 on. When the mosfet 212 is on, the amount of current flowing through primary winding 216 of the transformer 214 steadily increases as energy is stored in the primary winding 216. Each current sensing input 322 (see FIG. 3B) of PFC controllers 302, 304 (in FIG. 3A) is connected to terminal 222 of primary winding 216 of the transformer 214 of the first and second flyback circuits, respectively, to detect when the current flowing through the primary winding 216 reaches a threshold value. When the amount of current flowing through the primary winding 216 reaches the threshold value, the PFC controllers 302, 304 output a control signal having a minimum magnitude to turn the corresponding transistor 212 off. When the mosfet 212 is off, energy stored in the primary winding 216 is transferred to the secondary winding 218 and current is discharged through diode 220 to produce an output DC voltage to power the lamp 102 via a bulk capacitor 234 and inverter 122. As the current in the primary winding 216 decreases below the threshold value, as detected by the current sensing input pin 322, the transistor 212 turns on again. This process is repeated.

Figure 4:
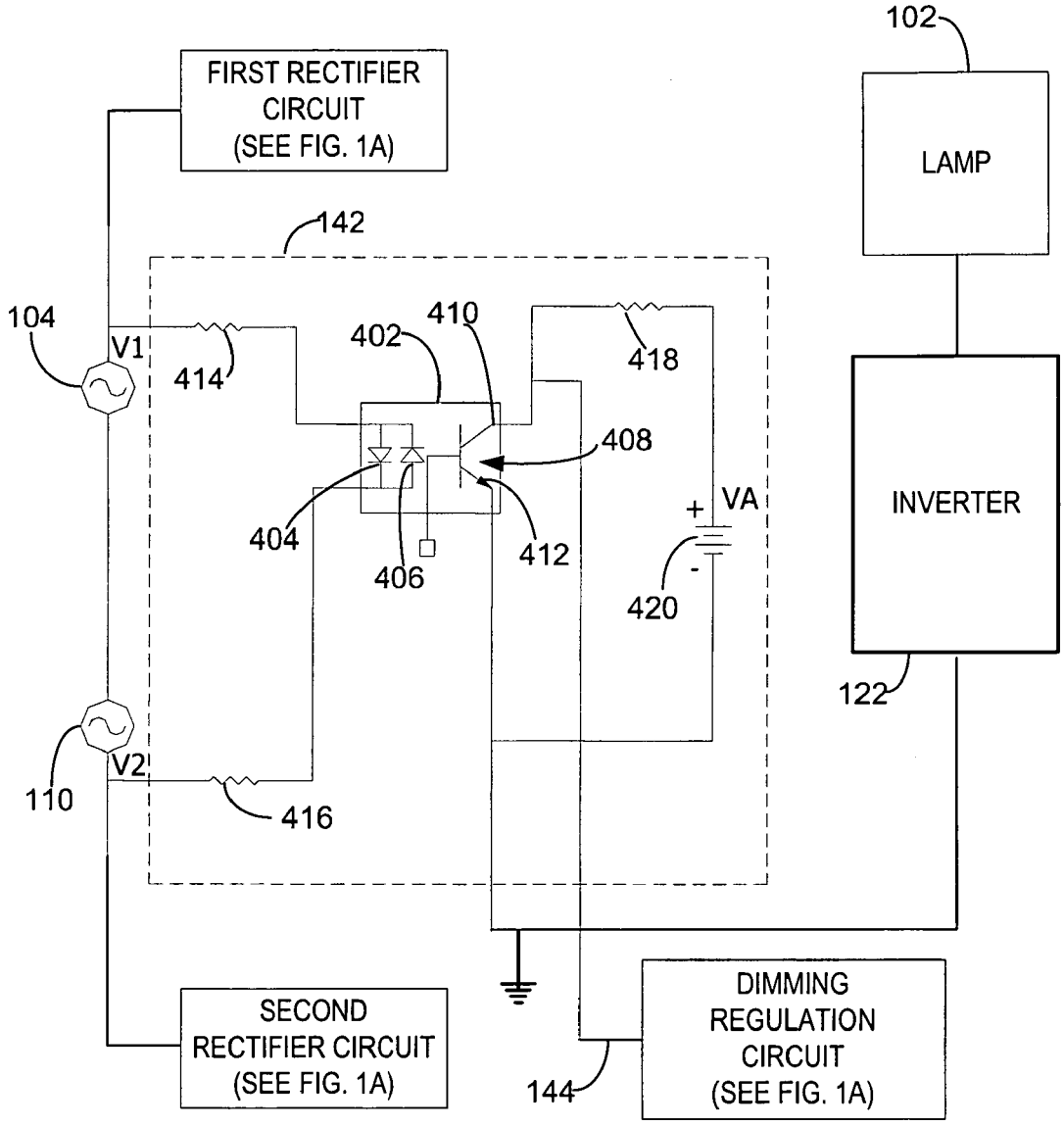
FIG. 4 is a schematic diagram illustrating the components of a multi-source detector, according to one preferred embodiment of the invention.

Referring now to FIG. 4, a schematic diagram illustrates the components of a multi-source detection circuit 142 according to one preferred embodiment of the invention. The multi-source detection circuit 142 includes a dual diode optocoupler 402 that produces the detection signal 144 to indicate whether both the AC voltage sources 104, 110 are supplying power to the circuit. The dual diode optocoupler 402 can be a HMHAA 280 dual diode optocoupler such as manufactured by Fairchild Semiconductor of South Portland, Me. The dual diode optocoupler 402 includes optodiodes 404, 406 and a transistor 408. When one of the first or second AC sources 104, 110 is turned off, none of the optodiodes conduct, and the transistor 408 of the optocoupler 402 does not permit current to flow from the collector 410 to the emitter 412. As a result, a voltage is generated across the collector 410 and emitter 412 of the transistor 408. This generated voltage is used as the detection signal 144 to indicate whether both the AC voltage sources 104, 110 are supplying power to the ballast circuitry. Thus, when the optocoupler 402 is off (i.e., when current does not flow from the collector 410 to the emitter 412 of transistor 408), the magnitude of the detection signal 144 is high. However, when both AC sources are turned on, both optodiodes 404, 406 conduct and the transistor 408 of the optocoupler 402 allows current to flow from the collector 410 to the emitter 412. When the opto-coupler 402 turns on there is a minimal voltage across collector 410 and emitter 412, and, thus, the magnitude of the detection signal 144 is low. The detection signal 144 can be used to decrease (i.e., dim) the brightness of the lamp connected to the ballast when the detection signal 144 has a high magnitude, which indicates that only one of the AC sources 104, 110 is supplying power. Resistors 414, 416 limit the current that is provided to the optodiodes 404, 406 respectively. Resistor 418 limits current being supplied from a DC voltage source (e.g., DC voltage supply 131).

Figure 5:
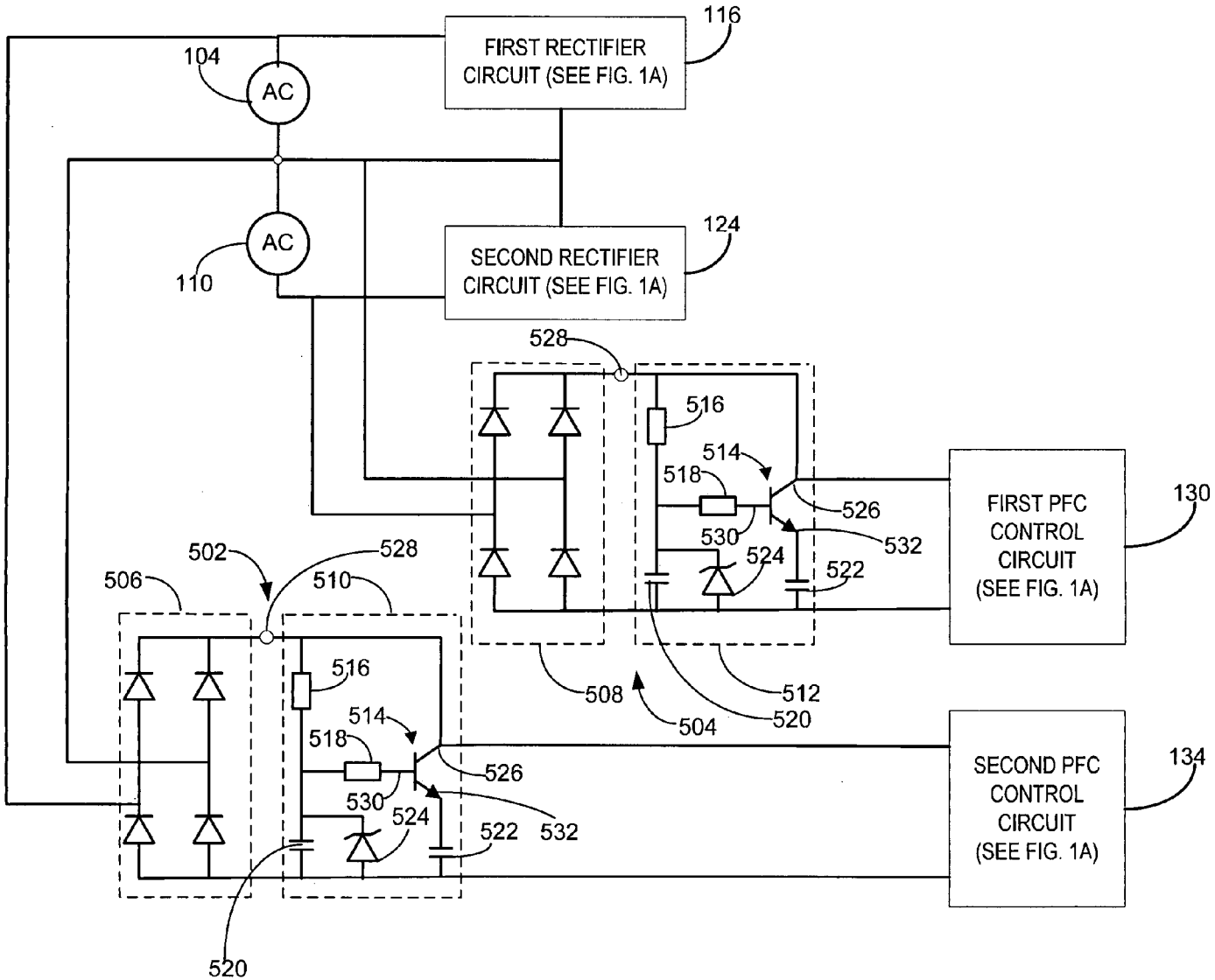
FIG. 5 is a schematic diagram illustrating the components of first and second 15 volt DC voltage circuits, according to one embodiment of the invention.

Referring now to FIG. 5, a schematic diagram illustrates the components of a first DC voltage supply circuit 502 (e.g., DC power supply 131) and a second DC voltage supply circuit 504 (e.g., DC power supply 135) according to one embodiment of the invention. The first and second AC voltage sources 104, 110 are connected to full wave rectifiers 506, 508 respectively. In the first DC voltage supply circuit 502, the rectifier 506 rectifies the first AC signal from the first AC voltage source 104 to produce a first DC voltage signal. In the second DC voltage supply circuit 504, the rectifier 508 rectifies the second AC signal from the second AC voltage source 110 to produce a second DC voltage signal. The first and second DC voltage signals are regulated to produce first and second DC supply voltages. In this embodiment, a first regulation circuit 510 is used to produce the first DC supply voltage, and a second regulation circuit 512 is used to produce the second DC supply voltage. Each of the regulation circuits 510, 512 includes a transistor 514, a first resistor 516, a second resistor 518, a first capacitor 520, a second capacitor 522, and a zener diode 524. A collector 526 of the transistor 514 is connected to terminal 528. The base 530 of the transistor 514 is coupled to terminal 528 via first and second resistors 516 and 518, and is coupled to ground via the second resistor 518 and the first capacitor 520. First capacitor 520 is coupled in parallel with the zener diode 524. The emitter 532 is connected to ground via the second capacitor 522. In this embodiment, the voltage produced across the second capacitor 522 is the target DC supply voltage and has a magnitude of approximately 15 volts. Accordingly, the first and second DC voltage supply circuits 502, 504 can be used as the first and second DC voltage supplies 131, 135, respectively, described above in reference to FIG. 2.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

The invention claimed is:

1. A ballast circuit for powering a lamp, said ballast circuit comprising:

a first rectifier circuit connected to a first alternating current (AC) source and generating a first direct current (DC) input power signal;

a second rectifier circuit connected to a second AC source and generating a second DC input power signal;

a first switching circuit connected to the first rectifier circuit for receiving the first DC input power signal, said first switching circuit generating a first DC output power signal as a function of the first DC input power signal;

a second switching circuit connected to the second rectifier circuit for receiving the second DC input power signal, said second switching circuit generating a second DC output power signal as a function of the second DC input power signal;

a dimming regulation circuit for generating a dim level command signal as a function of whether power is being supplied by each of the first and second AC sources to the lamp; and an inverter circuit coupled between the first and second switching circuits and the lamp, said inverter circuit responsive to the dimming regulation circuit to control an amount of power being provided to the lamp as a function of the dim level command signal.

2. The ballast circuit of claim 1, further comprising a first control circuit including a first PFC controller for controlling the first switching circuit, and a second control circuit including a second PFC controller for controlling the second switching circuit.

3. The ballast circuit of claim 2, wherein the first switching circuit includes a first transistor and a first transformer, said first transformer having a primary winding connected between the rectifier and the first transistor, and having a secondary winding connected to the inverter, wherein the first transistor is connected to the first controller to selectively provide DC power from the first rectifier to the primary winding of the first transformer, and wherein the DC power is transferred from the primary winding to the secondary winding of the first transformer to power the lamp, and wherein the second switching circuit includes a second transistor and a second transformer, said second transformer having a primary winding connected between the rectifier and the second transistor, and having a secondary winding connected to the inverter, wherein the second transistor is connected to the second controller to selectively provide DC power from the second rectifier to the primary winding of the second transformer, and wherein the DC power is transferred from the primary winding to the secondary winding of the second transformer to power the lamp.

4. The ballast circuit of claim 3, wherein the first PFC controller generates a first control signal for switching the first transistor on and off, wherein the first transformer stores DC power in the primary winding when first transistor is on and wherein the transformer transfers the DC power in the primary winding to the secondary winding of the first transformer to power the lamp when the first transistor is off, and wherein the second PFC controller generates a second control signal for switching the second transistor on and off, wherein the second transformer stores DC power in the primary winding when second transistor is on and wherein the transformer transfers the DC power in the primary winding to the secondary winding of the second transformer to power the lamp when second transistor is off.

5. The ballast circuit of claim 4, wherein the control circuit further comprises a first DC voltage supply supplying power to the first PFC controller, a second DC voltage supply supplying power to the second PFC controller, and wherein the first DC voltage supply is generated as a function of a first AC input signal being supplied by the first AC source and the second DC voltage supply is generated as a function of a second AC input signal being supplied by the second AC source.

6. The ballast circuit of claim 1, wherein the first and second switching circuits are flyback circuits.

7. The ballast circuit of claim 1, wherein the inverter circuit is responsive to the first and second DC output power signals and the dim level command signal having a peak amplitude to produce a dimming output AC signal for powering the lamp in a dimming mode, and wherein the inverter circuit is responsive to the first and second DC output power signals and a dim level command signal having a minimum amplitude to produce a non-dimming output AC signal for powering the lamp in a non-dimming mode.

8. The ballast circuit of claim 1, wherein the dimming regulation comprises a detection circuit connected to the first and second AC sources for generating a detection signal having a first state when both the first and second AC sources are supplying power to the lamp and having a second state when only one of the first and second AC sources is supplying power to the lamp.

9. The ballast circuit of claim 8, wherein the dimming regulation circuit generates a dim level command signal having a minimum amplitude when the detection signal is in the first state, and generates a dim level command signal having a peak amplitude when the detection signal in the second state, and wherein the inverter is responsive to a dim level command signal having a peak amplitude to produce an output AC signal having an increased frequency to dim the lamp, and is responsive to a dim level command signal having a minimum amplitude to produce an output AC signal having a reduced frequency to give full light output.

10. The ballast circuit of claim 8, wherein a magnitude of a voltage parameter of the detection signal has a first value when both of the first and second AC sources are supplying power and wherein the magnitude of the voltage parameter has a second value when only one of the first and second AC sources is supplying power, and wherein the dimming regulation circuit generates a dim level command signal having the minimum amplitude when the detection signal has the first value and generates a dim level command signal having the peak amplitude when the detection signal has the second value.

11. The ballast circuit of claim 8, wherein the detection circuit is a dual diode optocoupler having a first input connected to the first AC source and a second input connected to the connected to the second AC source, and having an output connected to the dimming regulation circuit, wherein said dimming regulation circuit receives the detection signal the via output of dual diode optocoupler.

12. The ballast circuit of claim 1, wherein:

the first rectifier circuit comprises a first bridge rectifier, said first bridge rectifier converting a first AC voltage signal output from the first AC source to a first input DC voltage signal;

the second rectifier circuit comprises a second bridge rectifier, said second bridge rectifier converting a second AC voltage signal output from the second AC source to a second input DC voltage signal;

the first switching circuit is connected to the first bridge rectifier to convert the first input DC voltage signal to a first output DC voltage signal;

the second switching circuit is connected to the second bridge rectifier to convert the second input DC voltage signal to a second output DC voltage signal; and the inverter circuit is connected to the first and second bridge rectifiers and the dimming regulation circuit for generating an AC output voltage signal as a function of the first output DC voltage signal, the second output DC voltage, and the amplitude of the dim level command signal to power the lamp.

13. The ballast circuit of claim 12, wherein the AC output signal has a first frequency for powering the lamp in a dimming mode, and wherein the AC output signal has a second frequency for powering the lamp in a non-dimming mode.

14. A method for powering a lamp connected to a ballast circuit, the method comprising the steps of:

supplying a first alternating current (AC) input signal and a second AC input signal to the circuit;

converting the first and second AC input signals into first and second direct current (DC) input signals, respectively;

generating a first DC output signal as a function of the first DC input signal and generating a second DC output signal as a function of the second DC input signal;

generating a dim level command signal as a function of whether each of the first and second AC input signals are being supplied to circuit; and supplying power to the lamp as a function of the dim level command signal and the first and second DC output signals.

15. The method of claim 14, wherein the step of generating a dim level command signal includes first generating a detection signal having a first state when both of the first and second AC input signals are being supplied to circuit and having a second state when only one of the first and second AC input signals is supplying power to the lamp, and wherein the generated dim level command signal has a minimum amplitude when the voltage parameter of detection signal has the first state and generating a dim level command signal having a peak amplitude when the voltage parameter of the detection signal has the second state, and wherein the step of supplying power to the lamp includes supplying power to the lamp to operate the lamp in a dimming mode when the dim level command signal has a peak amplitude, and supplying power to the lamp to operate the lamp in a non-dimming mode when the dim level command signal has a minimum amplitude.

16. The method of claim 15, wherein the step of supplying power to the lamp includes supplying an AC output signal for powering the lamp, wherein the AC output signal has a first frequency when the dim level command signal has a peak amplitude, and wherein the AC output signal has a second frequency when the dim level command signal has a minimum amplitude, and wherein the lamp is responsive to the AC output signal having the first frequency for powering the lamp in a dimming mode, and wherein the AC output signal has the second frequency for powering the lamp in a non-dimming mode.

17. A method for powering a lamp connected to a ballast circuit, the method comprising the steps of:

supplying a first input signal and a second input signal to the circuit;

generating a first output signal as a function of the first input signal and generating a second output signal as a function of the second input signal;

generating a detection signal having a parameter representative of whether each of the first and second input signals are being supplied to the circuit, wherein the parameter of the detection signal has a first magnitude when both of the first and second input signals are being supplied to the circuit and has a second magnitude when only one of the first input and second input signals are being supplied to the circuit; and supplying power to the lamp as a function of the generated detection signal and the first and second output signals.

18. The method of claim 17, wherein the step of generating a detection signal includes generating a detection signal having a first voltage parameter when both of the first and second input signals are being supplied to circuit and having a second voltage parameter when only one of the first and second input signals is being supplied to the circuit, and further includes generating a dim level command signal having a minimum amplitude when the detection signal has the first voltage parameter and generating a dim level command signal having a peak amplitude when the detection signal has the second voltage parameter, and wherein the step of supplying power to the lamp includes supplying power to the lamp to operate the lamp in a dimming mode when the dim level command signal has a peak amplitude, and supplying power to the lamp to operate the lamp in a non-dimming mode when the dim level command signal has a minimum amplitude.

19. The method of claim 18, wherein the step of supplying a first input signal and a second input signal to the circuit includes supplying first and second AC input signals, and wherein the step of generating a first output signal and a second output signal includes first converting the first and second AC input signals into first and second direct current (DC) input signals, respectively, and generating a first DC output signal as a function of the first DC input signal and generating a second DC output signal as a function of the second DC input signal, and wherein the step of supplying power to the lamp includes supplying power to the lamp as a function of the generated detection signal and the first and second DC output signals.

20. The method of claim 19, wherein the step of supplying power to the lamp includes supplying an AC output signal for powering the lamp, wherein the AC output signal has a first frequency when the dim level command signal has a peak amplitude, and wherein the AC output signal has a second frequency when the dim level command signal has a minimum amplitude, and wherein the lamp is responsive to the AC output signal having the first frequency for powering the lamp in a dimming mode, and wherein the AC output signal has the second frequency for powering the lamp in a non-dimming mode.

* * * * *